US005549470A

United States Patent [19]

Henderson

[11] Patent Number: 5,549,470

[45] Date of Patent: Aug. 27, 1996

[54] ANTI-FLAREUP DEVICE FOR LIQUID FUEL BURNERS

[76] Inventor: Richard W. Henderson, P.O. Box 12681, Florence, S.C. 29504

[21] Appl. No.: 365,804

[22] Filed: Dec. 29, 1994

[51] Int. Cl.[6] ..... F24C 15/20

[52] U.S. Cl. ..... 431/302; 431/7; 431/304; 431/317; 126/96

[58] Field of Search ..... 431/302, 7, 12, 431/15, 33, 34, 88, 304, 317; 126/96

[56] References Cited

U.S. PATENT DOCUMENTS

| | | | |
|---|---|---|---|
| 1,392,187 | 9/1921 | Mahan | 251/75 |
| 2,165,162 | 7/1939 | Thornton | 431/117 |
| 3,169,519 | 2/1965 | Aizawa | 126/96 |
| 3,501,252 | 3/1970 | Richardson | 431/33 |
| 4,363,620 | 12/1982 | Nakamura | 431/33 |
| 4,664,095 | 5/1987 | Takahashi | 431/15 |
| 4,797,088 | 1/1989 | Nakamura | 431/73 |
| 4,872,831 | 10/1989 | Fujimoto | 431/73 |
| 5,080,578 | 1/1992 | Josephs | 431/33 |
| 5,165,883 | 5/1992 | Van Bemmel | 431/6 |
| 5,338,185 | 8/1994 | Henderson | 431/33 |

FOREIGN PATENT DOCUMENTS 1205018 9/1970 United Kingdom .

OTHER PUBLICATIONS

Richard W. Henderson and George R. Lightsey, "Kerosene Heater Fires: Barometric Type," *Fire Marshals Bulletin* (87–5), pp. 8–10, Nov. 1987.

Richard W. Henderson and George R. Lightsey, "Kerosene Heather Fires: Barometric Type," *The National Fire and Arson Report*, vol. 6 (1), pp. 2–4 (1988).

Richard W. Henderson, "Barometric Kerosene Heaters," *Fire and Arson Investigator*, vol. 39 (3), pp. 26–27 (1989).

John J. Lentin:, "Gasoline and Kerosene Don't Mix–At Least, Not in Kerosene Heaters," *File Journal*, vol. 83 (4), pp. 13, 86 (1989) (Jul.–Aug.).

*Primary Examiner*—Larry Jones
*Attorney, Agent, or Firm*—David Pressman

[57] ABSTRACT

A safety device for preventing uncontrolled burning in wick-fed liquid fuel burners employs a thermal barrier between the heat of the combustion process and a removable fuel tank 60. Also, a fuel containment compartment (24) and fuel containment sump (44) are provided to receive fuel from the fuel chamber (40) when excess fuel is delivered to the fuel chamber from the removable fuel tank. When the fuel in the fuel chamber exceeds a predetermined level, a warning gauge needle 90 is deflected, alerting the user of the liquid fuel burner to a dangerous condition.

20 Claims, 2 Drawing Sheets

ANTI-FLAREUP DEVICE FOR LIQUID FUEL BURNERS

CROSS-REFERENCE TO RELATED APPLICATIONS

This invention is an improvement over the inventions of several earlier applications, to-wit: Ser. No. 08/130,290, filed 1993 Oct. 4, now U.S. Pat. No. 5,338,185, granted 1994 Aug. 16, in the names of Richard W. Henderson and George R. Lightsey; Ser. No. 08/247,925, filed 1994 May 23 now U.S. Pat. No. 5,456,595, granted 1995 Oct. 10, in the name of Richard W. Henderson; and Ser. No. 08/297,048, filed 1994 Sep. 30, now U.S. Pat. No. 5,409,370, granted 1995 Apr. 25, in the name of Richard W. Henderson.

BACKGROUND

1. Field of Invention

This invention relates to safety devices, specifically to a mechanism for prevention of flareup in barometric-type wick-fed liquid fuel burners.

2. Discussion of Prior Art

In wick-fed liquid fuel burners, such as kerosene heaters, liquid fuel from a fuel chamber is supplied to a wick which is exposed to the oxygen of the atmosphere. Once the wick has been ignited, flame intensity and heat generation are controlled by positioning the wick with respect to a wick-receiving combustion chamber.

A common type of kerosene heater is the barometric style, in which gravity causes liquid fuel to be delivered to a horizontal fuel chamber from a vertically-oriented, removable tank inserted into the fuel chamber. The flow of fuel from the removable tank into the fuel chamber is governed by a barometric valve in the cap on the removable tank, which, in normal operation, maintains the level of the fuel in the fuel chamber at the level of the barometric valve. A partial vacuum above the fuel in the removable tank prevents the fuel from flowing into the fuel chamber until the fuel level in the fuel chamber drops below the barometric valve, which allows air to enter the removable tank. As air enters the removable tank through the barometric valve, fuel in the removable tank flows into the fuel chamber until its level in the fuel chamber rises and covers the barometric valve in the removable tank cap, at which point fuel flow from the removable tank will cease.

The barometric valve consists of a spring-loaded plunger, which has an enlarged head at one end. When the removable tank is inserted into the fuel chamber, the plunger head contacts a pin located in the fuel chamber, which pushes the plunger back, allowing the fuel in the removable tank to be in fluid communication with the fuel chamber.

When the tank is removed, the action of the spring on the plunger head forces it against the opening in the tank cap, sealing the opening and preventing Fuel from leaving the tank. The capacity of the removable tank is typically about four to five liters (four to five quarts), while the fuel chamber can hold a maximum of about two liters (two quarts).

Various improvements have been made to such burners which make them safer to operate. For example, tip-over shut-off mechanisms, manual shut-off devices, and low-level $O_2$ detectors have been employed. However, these burners continue to cause fires that result in death, in jury, and property loss. These Fires are caused, because, under certain conditions, fuel can overflow the fuel chamber.

When the overflowing fuel ignites, the result is an uncontrolled fire, or flareup.

The most common reason for fuel overflow is the inadvertent use of fuels with high vapor pressures. Examples of such fuels are gasoline, naphtha, and inferior kerosene, which has a low flash point. In barometric heater, overflow of fuel from the fuel chamber can occur if the partial vacuum in the removable tank is lost. As the temperature of the heater and its surroundings increases, the vapor pressure of the fuel in the removable tank increases and, under certain conditions, allows fuel to escape from the removable tank at rate greater than the rate of burning of the fuel. Should this process continue, the fuel chamber will overflow, since the removable tank holds about two to three liters more than the capacity of the fuel chamber. When the fuel chamber overflows, the fuel spills onto the top of the fuel chamber, and can then ignite, causing an uncontrolled fire. A second way that the partial vacuum in the barometric heater's removable tank can be lost is by air entering through compromise of the integrity of the removable tank.

There are safety devices that drop the wick down, thereby extinguishing the flame, if the burner tips over or experiences excessive vibration, or if abnormal combustion is detected. Other safety devices detect high levels of $CO_2$ and low levels of $O_2$ in the vicinity of the heater, and use these to control burning rates. Still others regulate the position of the wick during the ignition and extinguishing operations of the heater to prevent excessive flaming during these operations. Examples are shown in U.S. Pat. No. 4,363,620, issued Dec. 14, 1982 to Nakamura; U.S. Pat. No. 4,872,831, issued Oct. 10, 1989 to Fujimoto; U.S. Pat. No. 4,797,088, issued Jan. 10, 1989 to Nakamura; and U.S. Pat. No. 5,165,883, issued Nov. 24, 1992 to Van Bemmel. However, not only do these devices fail to prevent flareup, they are ineffective in stopping flareup after its onset. In some cases, the safety devices require the use of electrical power and electronic circuitry for actuation, and would increase the cost of the burners significantly, without rectifying the flareup problem.

It has been suggested in two publications ("Kerosene Heater Fires: Barometric Type," R. Henderson et al., *Fire Marshals Bulletin* (*National Fire Protection Association*), Vol. 87–5, p. 8 (1987); "Barometric Kerosene Heaters," R. Henderson, *Fire and Arson Investigator* (International Association of Arson Investigators), Vol. 39, No. 3, p. 26 (1989)) to make the size of the removable tank of barometric kerosene heaters comparable in volume to that of the fuel chamber so that flooding of the fuel chamber will not occur. To implement this suggestion, either the capacity of the removable tank must be reduced, or alternatively, that of the fuel chamber must be increased. However, reducing the capacity of the removable tank will reduce the burn time accordingly, and possibly affect the marketability of the heaters. Increasing the capacity of the fuel chamber will require that new tanks be designed and implemented.

Also, it has been suggested that a float device be introduced into the fuel chamber to be used to activate the automatic wick extinguishing mechanism, and a sight gauge be present to show dangerous fuel levels in the fuel chamber. Introduction of such a float device would also require that the fuel chamber be redesigned, as discussed above. Although some burners have sight gauges in the fuel chamber, the sight gauges are used only to indicate whether or not fuel is present, not when dangerous fuel levels are present in the fuel chamber.

In addition it was proposed that a tank block-out device be installed, in which a float in the reservoir would push on a pin that could move should the removable tank be withdrawn from the heater. Once again, such a device would require a redesigning of the fuel chamber and insertion of moving parts inside a somewhat restricted space. Also, this type of device would not prevent the entire contents of the removable tank from flowing into the fuel chamber, since it becomes operable only after the removable tank has been withdrawn.

U.S. Pat. No. 5,080,578, issued Jan. 14, 1992 to Josephs, claims that its device controls flareup in wick-fed liquid fuel burners by a) cutting off the flow of fuel to the wick in response to excessive heat by blocking a fuel line, and b) withdrawing the wick into the wick chamber when sensing excessive heat. However, Josephs' device has several disadvantages:

a) Excessive heat must be generated near the sensors before the flow of fuel is interrupted, or the wick is withdrawn. Therefore, since flareup is not prevented, the device only limits the spread of excessive flames after flareup has already occurred.

b) Excessive heat sensing devices must be near the area where uncontrolled burning is taking place due to overflow of fuel. Often the path that the overflowing fuel takes is random and flareup may not initially occur near the heat sensors.

c) The device is not applicable to barometric liquid fuel burners—the most common wick-fed liquid fuel burners in use—because these burners do not have fuel lines.

d) From the onset of flareup in wick-fed liquid fuel burners, fire is present outside the wick; therefore, retracting the wick does not affect the flareup process.

The device of the above-referenced related patent of Henderson and Lightsey consists, in part, of an excess fuel containment compartment below the level of the fuel chamber. It prevents flareup by activating a wick-extinguishing mechanism when the presence of excess fuel is detected in the fuel chamber. While this device has much merit, to be effective it requires activation of a second mechanism, that is, an automatic wick extinguisher. Should that mechanism fail to respond, due to tar buildup on the wick or a mechanical problem, flareup may still occur in some situations.

The device of the above-referenced related patent application of Henderson, U.S. Pat. No. 5,456,695 of Henderson, prevents flareup by lifting the removable tank when excess fuel is present in the fuel chamber, thereby shutting off the barometric valve and stopping fuel flow from the removable tank. For this device to work, it is necessary to provide a spring to lift the removable tank and its contents (liquid fuel), the total weight of which can be up to some five kilograms (ten pounds). Accordingly, should the spring lose strength, or should the removable tank become hindered in its upward movement, this device may not be able to prevent flareup in some situations.

The device of the above-referenced related patent application of Henderson, U.S. Pat. No. 5,409,370 of Henderson, prevents flareup by dropping the pin which holds open the barometric valve in the removable tank cap, thereby closing the valve and stopping fuel flow into the fuel chamber. Should the valve not close properly, or should some other mechanical malfunction occur, this device may not prevent flareup in some situations.

OBJECTS AND ADVANTAGES

Accordingly, several objects and advantages of the present invention are to provide an improved and safer wick-fed, barometric, liquid fuel burner, to provide such burner with a safety device which does not require the reduction in capacity of the removable fuel tank, does not require the redesigning of the fuel chamber to increase its capacity or to accommodate a float device, does not require electrical power or electronic circuitry, does not require the presence of excessive heat for its actuation, is applicable to kerosene heaters that do not have fuel lines, and does not involve the use of mechanical devices or moving parts for the prevention of flareup.

Another object is to provide such a burner with a safety device which prevents fuel overflow from the fuel chamber, and therefore, prevents flareup.

In addition, the present burner does not have any substantially increased weight, will save lives and property, will make barometric liquid fuel burner easier to market because of added safety value, and will likely reduce the number of expensive lawsuits prompted by injury, loss of life, and property damage.

Still further objects and advantages will become apparent from a consideration of the ensuing description and drawings.

Figure 1:
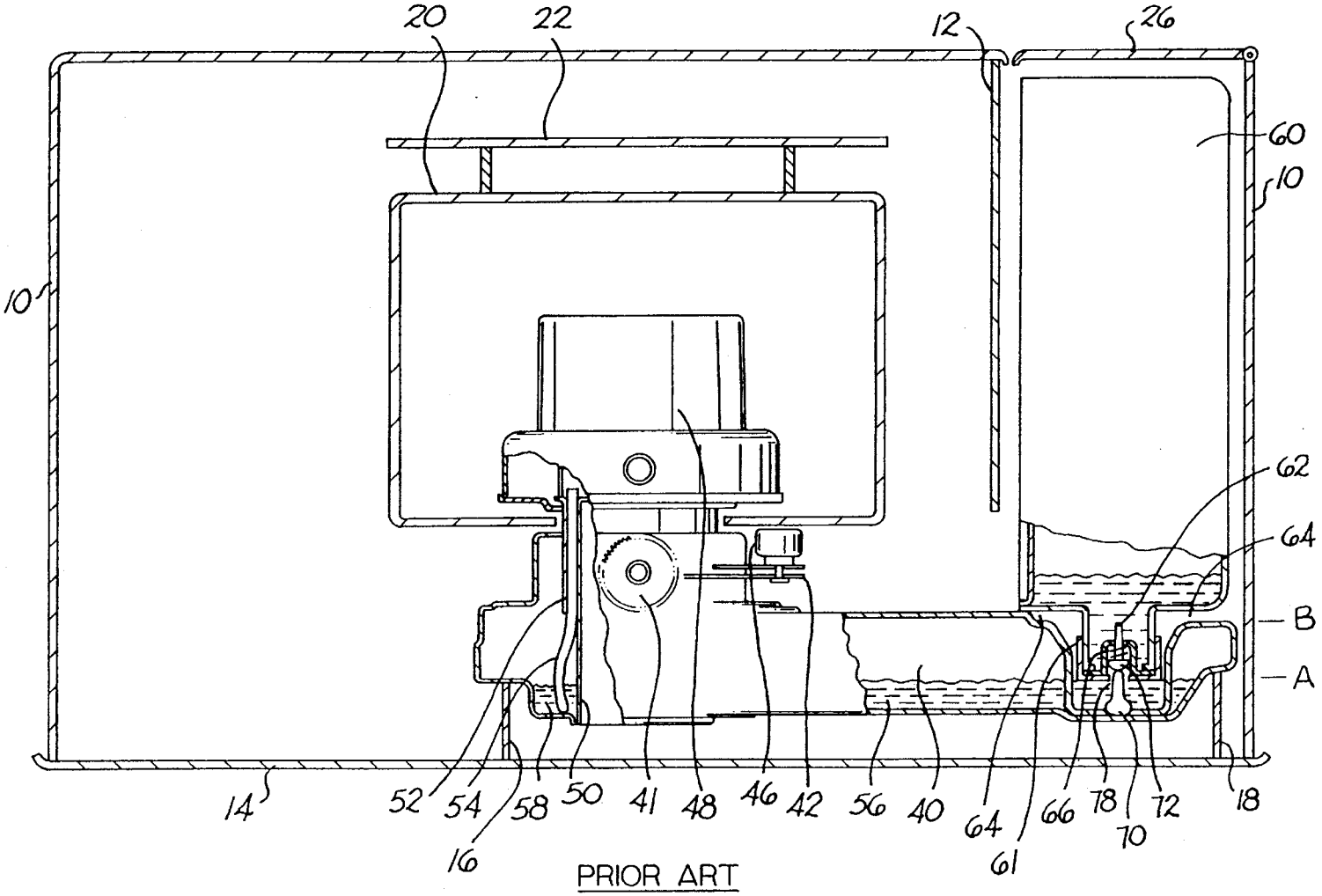
PRIOR ART FIG. 1
FIG. 1 is a side sectional view of a prior-art, wick-fed, barometric liquid fuel burner with an automatic wick extinguishing unit that can be activated by a vibration-sensing weight.

| DRAWING REFERENCE NUMERALS | |
|---|---|
| 10 | Cabinet |
| 12 | Tank guide |
| 14 | Base tray |
| 16 | Support |
| 18 | Support |
| 20 | Reflector |
| 22 | Plate |
| 24 | Fuel containment compartment |
| 26 | Lid |
| 28 | Support |
| 30 | Overflow tube |
| 32 | Deflector |
| 34 | Air diverter |
| 36 | Support |
| 38 | Support |
| 40 | Fuel chamber |
| 41 | Wick gear |
| 42 | Automatic wick extinguishing unit |
| 44 | Fuel containment sump |
| 46 | Vibration-sensing weight |
| 48 | Combustion cylinder |
| 50 | Inner wick guide |
| 52 | Outer wick guide |
| 54 | Wick |
| 56 | Fuel |
| 58 | Fuel supply reservoir |
| 60 | Removable fuel tank |
| 61 | Tank cap |
| 62 | Plunger |
| 64 | Opening |
| 66 | Plunger spring |
| 68 | Support |
| 70 | Pin |
| 72 | Plunger head |
| 74 | Opening |
| 76 | Opening |
| 78 | Orifice |

-continued

| DRAWING REFERENCE NUMERALS | |
|---|---|
| 80 | Opening |
| 82 | Orifice |
| 84 | Float |
| 86 | Arm |
| 88 | Sleeve |
| 90 | Warning gauge needle |
| A | Normal fuel level |
| B | Flooded fuel level |

SUMMARY

In accordance with the present invention, an anti-flareup safety device for wick-fed, barometric liquid fuel burners provides a thermal barrier which insulates the removable tank from the heat of the combustion process so that during operation of the burner, the temperature of the fuel inside the removable tank does not reach such a level that the vapor pressure of even a high-volatility fuel, such as gasoline, will counteract the partial vacuum in the removable tank to such an extent that the barometric valve in the cap on the removable tank no longer controls the movement of fuel from the removable tank into the fuel chamber, The safety device includes a fuel containment system to receive and hold any excess fuel delivered to the fuel chamber from the removable tank. This system consists of a fuel containment sump and a fuel containment compartment. In addition, a warning gauge provides a visual indication when the burner is in an unsafe condition.

DESCRIPTION—CONVENTIONAL HEATER STRUCTURE—FIG. 1

FIG. 1 is a side sectional view of a conventional wick-fed, barometric liquid-fuel burner that operates by burning a liquid fuel, such as kerosene. The burner is a wick-fed type with a combustion cylinder 48 and is constructed in a manner widely known in the art. One manufacturer of the burner of FIG. 1 is Toyotomi of Japan, and such manufacturer sells such burners under the trademark Envirotemp by Kero-Sun.

In normal operation fuel is delivered from a removable fuel tank 60 to a horizontal fuel chamber 40 through an orifice 78 in a tank cap 61 on tank 60. Tank 60 is held in a vertical position by a tank guide 12 in a cabinet 10 in accordance with the common practice of the industry. Cap 61, which is attached to the neck of tank 60, is inserted into a mating well, or sump, in the top surface of chamber 40, also the common practice in the industry.

When the fuel level in chamber 40 drops below level A due to fuel consumption by wick 54, air will bubble into tank 60 through orifice 78 in tank cap 61, and fuel (e.g., kerosene) will flow from tank 60 into chamber 40 until the level in chamber 40 rises back to level A the fuel maintenance level. A partial vacuum above the fuel in tank 60 maintains the fuel in tank 60 above level A until all of the fuel has been discharged From tank 60. Fuel 56, which is in fluid communication with wick 54 via wick fuel supply reservoir 58, migrates by capillary action up the wick and is burned inside combustion cylinder 48, which generally consists of several inner metal cylinders and an outer glass cylinder. Cylinder 48 provides a surface for the burning of the fuel, and radiates heat and some light. The flame is not shown, but is seen as a red glow above the wick in cylinder 48.

Wick 54, cylindrical in shape and shown in a partial cross-sectional view, can be moved up or down between inner wick guide 50 and outer wick guide 52 by rotating a wick gear 41. Wick 54, wick guides 50 and 52, combustion cylinder 48, wick fuel supply reservoir 58, and vibration-sensing weight 46 in FIG. 1 are circular in shape when seen from above, whereas compartment 40 is generally rectangular. Removable fuel tank 60 is most commonly rectangular in shape as viewed from above, but various other shapes are also found, such as triangular. Tank cap 61 is cylindrical in shape, and is threaded to allow attachment to tank 60.

The fuel burner has an automatic wick extinguishing unit 42, which includes a vibration-sensing weight 46. If the burner is tilted or vibrated excessively, this could spill the fuel and create a fire. To prevent this, unit 42 senses the vibration, and disengages wick gear 41, which lowers wick 54, extinguishing the flame, or actuates any other wick extinguishing mechanism (not shown).

The burner components are attached to base tray 14 through supports 16 and 18, which tray provides stability to hold the unit in an upright position the typical fashion of the industry. Tray 14 is generally rectangular, with dimensions of approximately 90 cm (3 ft) by 30 cm (1 ft). The bottom of chamber 40 is about 5 cm (2 in) above tray 14.

A polished metal reflector 20 directs the heat from combustion cylinder 48 out of the front of the burner, in the typical fashion of the industry. A metal plate 22 extends horizontally above reflector plate 22 is typically rectangular in shape, and acts to reduce the operating temperature of the top of cabinet 10. In some burners, several plates are utilized, being stacked above each other and separated by about 1 cm (0.5 in) from each other. A lid 26 is located over tank 60, and is hinged in its connection to cabinet 10 so that removable tank 60 can be inserted into and removed from the cabinet.

OPERATION AND DANGER OF FLAREUP WITH CONVENTIONAL BURNER—FIG. 1

If the partial vacuum in tank 60 is lost, the barometric system described earlier no longer regulates fuel flow from tank 60. The partial vacuum may be lost by compromise of the integrity of tank 60, or by the presence of a high vapor pressure fuel in tank 60. Most flareup incidents occur when a high-volatility fuel is inadvertently introduced into tank 60—most commonly, gasoline or gasoline-contaminated fuel. As a result, excessive fuel will flow into chamber 40. Since the capacity of tank 60 is about two liters greater than that of chamber 40, chamber 40 will not be able to contain all of the fuel from tank 60, if any significant amount of fuel is present in tank 60. As a result, fuel fills chamber 40 and then overflows via opening 64 between tank 60 and the top of chamber 40. The fuel spreads over the fuel chamber's surface and to other areas in the burner. The flooded fuel will ignite because the vapors from the leaked fuel are drawn by air movement toward the wick flame (not shown) in cylinder 48, which is of sufficient temperature to ignite these fumes. As a result, there will be flames in and around tank 60, causing the pressure inside tank 60 to increase dramatically, driving more fuel out of tank 60, which further increases the amount of escaped fuel, and accordingly increases the severity of the flareup.

Flareup incidents involving high-volatility fuels do not occur immediately after the burners are lit, but rather after an induction period of one or more hours. There is a delay because these burners are utilized for heating purposes at cooler ambient temperatures. At such temperatures, even the high-volatility fuels have vapor pressures low enough that the partial vacuum above the liquid in the removable tank is adequate to maintain the column of fuel in the tank, which requires a pressure differential of only approximately 3 Kilo-Pascals (kPa) (0.4 psi ) for the 36 cm (14 in) height typical of removable tanks.

For example, at 21° C. (70° F.) the vapor pressure of the most volatile class of gasoline, Class E, is on the order of 69 kPa (10 psi). Since ambient pressure is around 101 kPa (14.7 psi), a column of gasoline nearly 5 m (15 ft) high could be maintained at such a pressure differential. However, should the temperature of the gasoline reach 38° C. (100° F.)—the approximate boiling point of gasoline—its vapor pressure will increase to about 101 kPa (14.7 psi), and the fuel will flow out of the removable tank and into the fuel chamber in an uncontrolled manner. This will circumvent the normal operation of the barometric valve. The increase in temperature of the air space in the removable tank during operation of the burner is not a significant factor in the loss of the partial vacuum in the removable tank. This is because the temperature increases are not rapid enough to overcome the normal action of the barometric valve in controlling fuel flow from the removable tank as fuel is consumed by the wick.

Unless the burner is in a very low temperature environment the temperature of the removable tank will typically exceed 38° C. (100° 0F.) during operation of the burner. The removable tank achieves such temperatures due to its proximity, about 13 cm (5 in), to the combustion process, which reaches temperatures in excess of 850° C. (1600° F.). During operation of the burner, heat is transferred by radiation, convection, and conduction processes from the reflector to the tank guide. The tank guide is immediately adjacent to and in contact with the removable tank, and is present to maintain the positioning and vertical orientation of that tank. In addition, during operation of the burner, there is a significant increase in temperature of the top surface of the cabinet, in particular, in the vicinity of the tank guide. This results in a corresponding increase in temperature of the tank guide, and accordingly, the removable tank.

The typical flareup scenario in such burners is as follows: Initially, the fuel in the removable tank is at a low enough temperature so that its vapor pressure is insufficient to allow liquid to flow from the removable tank beyond that allowed by the barometric valve. At this point, the liquid level in the fuel chamber will be maintained at the level of the barometric valve, which allows fuel to flow from the removable tank into the fuel chamber only as fuel is consumed by the wick. The temperature of the removable tank, and the fuel inside it, increases as thermal equilibrium is established in the burner, causing the vapor pressure of the fuel to increase. Then the increased vapor pressure of the fuel compromises the partial vacuum inside the removable tank, allowing fuel in the removable tank to flow into the fuel chamber in an uncontrolled manner. Since the capacity of the removable tank (4–5 liters) far exceeds that of the fuel chamber (1–2 liters), the fuel chamber fills and overflows. The vapors from the spilled fuel ignite and flareup ensues.

With the exception of the Henderson and Lightsey device, and the Henderson tank-lift and pin-drop devices, prior-art safety devices do not prevent flareup, but rather detect evidence that flareup has begun, and then trigger an automatic wick extinguishing unit, which acts to extinguish the flame on the wick. However, by the time flareup has begun, there are flames outside the wick area and extinguishment of the wick flame does not affect the progression of flareup. The flames are present where fuel has flooded, and the increasing amounts of fuel being discharged from the removable tank further increase the magnitude of the flareup incident, as described earlier.

The Henderson and Lightsey device is designed to extinguish the flame on the wick prior to flareup. However, if the wick-drop mechanism fails to operate when activated as a result of the wick becoming encrusted, or if there is some other problem with the wick shut-off mechanism, this device may not be able to prevent flareup. The two Henderson devices are designed to shut off fuel flow from the removable tank to the fuel chamber by separating the removable tank from the pin that opens the barometric device in the cap on the removable tank cap. However, the Henderson devices have in common the feature that should they not operate properly to shut the heater off, the fuel chamber may overflow and flareup may result.

Thus, prior-art safety devices, such as those which monitor excessive vibration of the burner, which detect high levels of $CO_2$ and low levels of $O_2$, which detect abnormal combustion, and which regulate the position the wick to prevent excessive flaming, are ineffective in preventing flareup. The safety device described in the Josephs patent, supra, does not prevent flareup, but rather provides a wick drop mechanism, and cuts off fuel flow through a fuel line after the onset of flareup. Since the wick-fed barometric liquid fuel burners in common use do not utilize a fuel line, Josephs' device is not applicable to them. The Henderson and Lightsey, and two Henderson devices, are designed to prevent flareup, but should they not activate properly, flooding of the fuel chamber may occur and flareup may result.

DESCRIPTION OF INVENTIVE ANTI-FLAREUP DEVICE—FIG. 2

Figure 2:
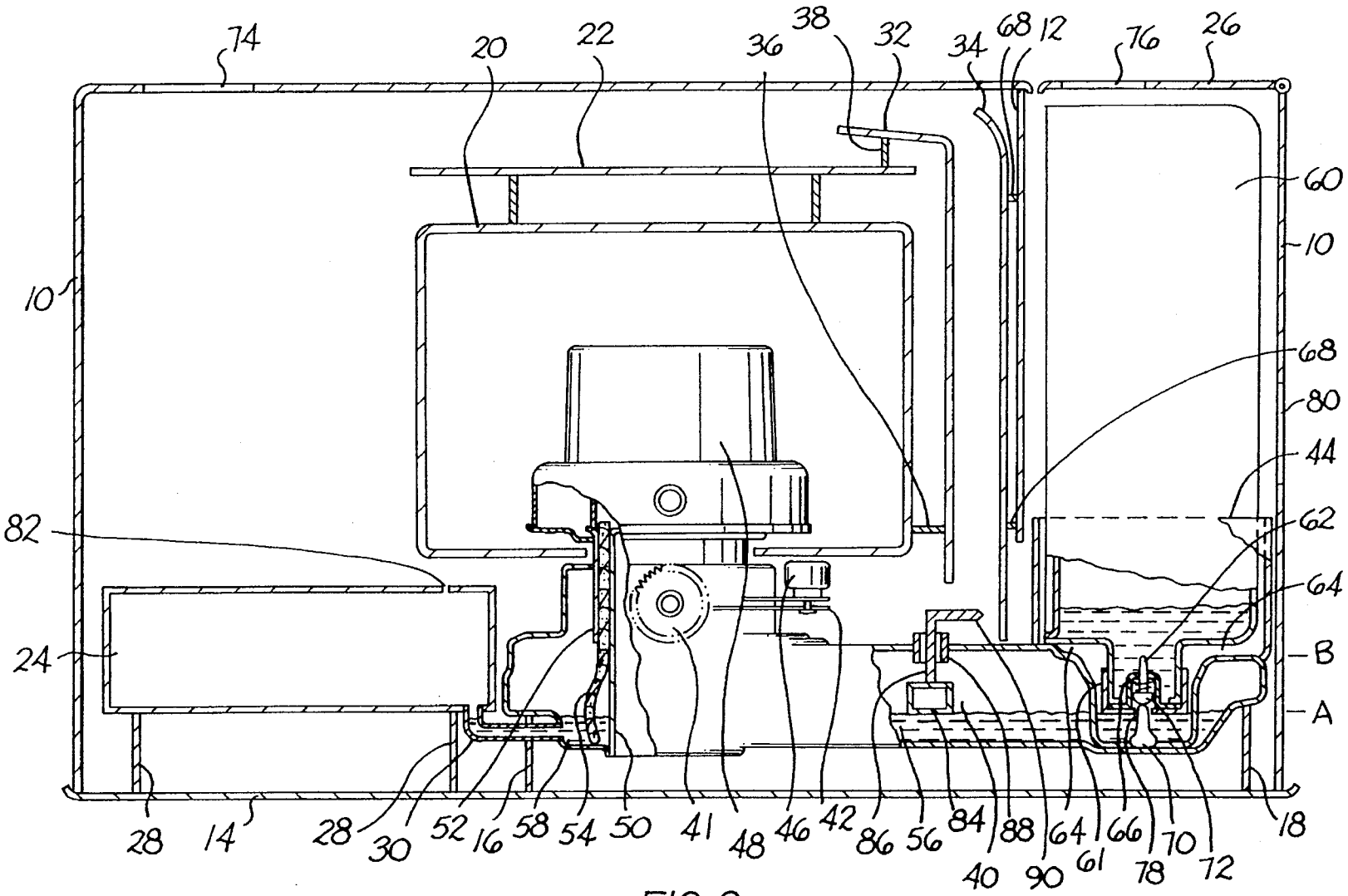
FIG. 2 is a side sectional view of a wick-fed, barometric liquid fuel burner with an anti-flareup safety device in accordance with the preferred embodiment of the present invention.

These problems are solved by the wick-fed barometric liquid fuel burner of FIG. 2. It operates by providing: a) a barrier that insulates the removable tank from the heat of the combustion process, b) a containment system for any excess fuel in the fuel chamber, and c) a warning gauge to alert the user should there be a dangerous condition in the burner. It includes the following conventional elements: a removable tank 60 with a tank cap 61 which houses a spring-loaded plunger 62 functioning as a barometric valve in the usual fashion of the industry, a fuel chamber 40, a wick 54, a wick gear 41, a combustion cylinder 48, a vibration-sensing weight 46, a base tray 14, an automatic wick extinguishing unit 42, a cabinet 10 with a lid 26 over the opening for tank 60, a reflector 20, a plate 22, and a tank guide 12.

In addition, the burner of FIG. 2 includes additional elements which constitute a preferred embodiment of the present inventive anti-flareup safety device.

A deflector 32 is situated between reflector 20 and tank guide 12. It extends toward the front and back of cabinet 10, and downward along the side of reflector 20 and over the top of reflector 20. Deflector 32 is curved so as to direct the movement of any air flow away from tank 60. The position of deflector 32 is maintained by attachment, by supports 36 and 38, to plate 22 and reflector 20, or any other convenient members. The composition of detector 32 is preferably metal, and its dimensions are approximately 20 cm (8 in) by 35 cm (14 in), with a thickness sufficient to maintain its shape.

An air diverter 34 is situated between deflector 32 and tank guide 12, and extends toward the front and back of cabinet 10, from just under the top of cabinet 10 to the top of chamber 40. Diverter 34 is supported by attachment by supports 68 to guide 12. The composition of diverter 34 is preferably metal, and its dimensions are about 20 cm (8 in) by 30 cm (12 in), with a thickness sufficient to maintain its shape. The top of diverter 34 is curved so that the movement of any air flow is directed away from tank 60.

Located in the top surface of cabinet 10 is a path for heated air egress, which path consists of an opening 74, which is circular, and has a cross-sectional area of approximately 56 $cm^2$ (9 $in^2$). In lid 26 is a path for heated air egress, which path consists of an opening 76, which is circular, and which has a cross-sectional area of approximately 6 $cm^2$ (1 $in^2$). In the lower part of cabinet 10 in the vicinity of tank 60 is a path for cool air ingress, which path consists of an opening 80, which is circular, and which has a cross-sectional area of approximately 25 $cm^2$ (4 $in^2$).

A fuel containment sump 44 extends upward from chamber 40 and is in continuous, liquid-tight contact with chamber 40, extending completely around the lower portion of tank 60. A fuel containment compartment 24 is located adjacent to and to the side of chamber 40, with which it is in fluid contact via an overflow tube 30. As shown, tube 30 extends horizontally out from the side of an adjacent the bottom of chamber 40, and extends up to compartment 24, which is positioned above chamber 40, i.e., its bottom is higher than the bottom of chamber 40. Orifice 82, which is located in the top surface of compartment 24, is circular in shape and about 0.25 cm (0.1 in) in diameter. Tube 30, which is cylindrical in shape, is about 2.5 cm (1 in) long and 0.6 cm (0.25 in) in diameter.

When viewed from above, compartment 24 and sump 44 preferably have a rectangular shape, but may have other shapes. The dimensions of compartment 24 are approximately 15 cm (6 in) wide by 18 cm (7 in) long by 10 cm (4 in) deep. The dimensions of sump 44 are about 10 cm (4 in) wide by 15 cm (6 in) long by 8 cm (3 in) deep.

A float 84, which is located in fuel chamber 40, is attached to the bottom of an arm 86, which extends upward vertically through a sleeve 88 that penetrates the upper surface of chamber 40. A warning gauge needle 90 is attached to the top of arm 86, which is free to move in a vertical manner through sleeve 88. Float 84 may be any convenient shape, such as spherical, so long as it has sufficient displacement, about 8 $cm^3$ (0.5 $in^3$), to move arm 86 and needle 90 upward when excess fuel envelopes float 84. Arm 86 is preferably cylindrical, and is about 7.6 cm (3 in) long, and 0.5 cm (0.2 in) in diameter. Sleeve 88 is cylindrical, and is approximately 5 cm (2 in) long and 0.2 cm (0.1 in) in diameter.

OPERATION OF INVENTIVE ANTI-FLAREUP DEVICE—FIG. 2

After ignition of the wick, the burner components begin to increase in temperature. The hottest location in the burner components is in the vicinity of cylinder 48, especially over it. As reflector 20, plate 22, deflector 32, and air diverter 34 become warmer during operation of the burner, cool air ingresses through the bottom of the burner and rises past these components. The resulting warmed air is directed away from tank 60, finally egressing out opening 74 and the top of cabinet 10, carrying heat away from tank 60. As tank 60 becomes warmer, convection processes induce cool air to ingress through opening 80 in cabinet 10, and to egress through opening 76 in lid 26, which acts to cool tank 60.

Tests of a contemporary burner equipped with the present inventive insulating device have shown that the temperature increase of the fuel in tank 60 does not exceed about 11° C. (20° F.) above ambient. Since these burners are typically operated when the ambient temperature is less than 21° C. (70° F.), the maximum temperature reached by the fuel in tank 60 will be around 32° C. (90° F.) during operation of the burner. Since at 32° C. gasoline has a vapor pressure of approximately 93 kPa (13.5 psi), the differential in pressure between ambient and that inside the tank would be about 8 kPa (1.2 psi), well in excess of the 3 kPa (0.4 psi) pressure difference necessary to support the column of fuel in the removable tank. Thus, fuel flow from that tank will continue to be controlled by the action of the barometric valve.

In the unlikely event of a substantial drop in ambient pressure, and a simultaneous significant temperature excursion by the fuel in tank 60, the pressure differential between the inside and the outside of tank 60 may be insufficient to maintain the column of gasoline inside tank 60, and fuel will flow out of tank 60 in an uncontrolled manner. If, as a result, excess fuel enters chamber 40, the excess fuel will flow into sump 44, and also into compartment 24 from chamber 40 through tube 30. Since the combined capacity of chamber 40, compartment 24, and sump 44 exceeds the capacity of tank 60, overflow of fuel will not occur. The wick will continue to burn until the fuel in the fuel chamber is consumed, and the normal status of the burner is thereby restored.

Should excess fuel enter chamber 40, float 84 will be buoyed upward. In response, arm 86 will move upward, causing needle 90 to deflect, thereby providing a visible warning of the dangerous condition of the burner.

ADVANTAGES

It is clear from the discussion above that the anti-flareup safety device is quite simple in construction and can be readily and inexpensively incorporated in wick-fed barometric liquid fuel burners. Yet it will prevent flareup by providing a thermal barrier which isolates the removable tank from excessive temperatures, thereby preventing loss of fuel from the removable tank beyond that allowed by the normal operation of the barometric valve. This will be so even when high-volatility fuels such as gasoline are inadvertently introduced into the burner. In addition, it provides a fuel containment system that can receive and hold the contents of the removable tank should the fuel in the removable tank reach excessive temperatures, or the ambient pressure should drop significantly, or in the event that excessive amounts of fuel are lost from the removable tank.

Also, the device includes a warning gauge needle to indicate danger when there is excess fuel in the fuel chamber, thereby alerting the user to the dangerous condition of the burner.

The present device prevents the burning of fuel outside its intended site, that being at the wick, thereby saving fuel and reducing odor. Also, the device does not require any electrical power or electronic circuitry, and does not involve mechanical devices or moving parts for the prevention of flareup.

Clearly, the device incorporates multiple safety features, which will make wick-fed, barometric liquid fuel burners safer to operate, and accordingly, will at the same time reduce the expensive lawsuits resulting from flareup incidents causing injury, loss of life, and property damage. As a result these burners will be easier to market.

RAMIFICATIONS AND SCOPE

Those skilled in the art can now appreciate from the foregoing description that the broad teachings of the present invention can be implemented in a variety of forms. Therefore, while the safety device has been described in connection with particular examples thereof, the true scope of the invention should not be so limited since other modifications will become apparent to the skilled practitioner upon a study of the drawings, specification and following claims.

For example, the shapes and composition of the various parts of the safety device can be varied greatly, so long as their function is preserved. Thus, while the overflow tube is depicted as being cylindrical, clearly it can have other shapes, such as oval, square, rectangular, etc. Also, the overflow tube may consist of several openings and may be connected to the fuel chamber at other locations along its perimeter rather than as depicted. The fuel containment compartment may be attached directly to the fuel chamber, with the overflow tube being replaced with an opening in the respective walls of the compartment and chamber. The dimensions of the various compartments may be varied somewhat, so long as the combined capacity of the fuel chamber, the fuel containment sump, and the fuel containment compartment exceeds the capacity of the removable tank.

The fuel containment compartment and fuel containment sump are described as being square or rectangular when viewed from the top, but may be oval, circular, etc. The dimensions of the fuel containment compartment are governed by the amount of space available adjacent to the fuel chamber. The height of the fuel containment compartment may be increased and the orifice eliminated. Also, the deflector and air diverter may be attached at convenient locations other than as shown, and their shapes and dimensions may be varied, so long as their insulating function is not compromised. The various openings for air flow do not have to be circular, but may be oval, square, rectangular, or other convenient shape, and the number and size of the various openings may be varied, so long as their function is maintained.

The warning gauge feature may be configured to monitor the fuel level in the fuel chamber, or in the fuel containment sump. While the preferred composition of the various parts of the safety device and appurtenant components is metal, other materials may also be utilized, such as plastics, asbestos sheet, composites, etc. The float may be made of cork, or other low-density materials. In addition, mineral-type, fiberglass, plastic, or other insulating materials may be used to thermally isolate the removable tank from the heat of the combustion process.

Also, the device may be connected to or used in combination with other safety devices, such as shutoff mechanisms. The warning gauge may be eliminated, and either the insulating aspect of the device or the excess fuel containment system may be utilized alone.

Thus the scope of the invention should be determined, not by the examples given, but by the appended claims and their legal equivalents.

What is claimed is:

1. An apparatus for preventing flareup in a liquid fuel burner of the type comprising:

(a) a removable liquid fuel tank, (b) a fuel chamber, (c) an automatic wick extinguishing unit, (d) a combustion chamber having a wick, (e) a reflector adjacent said combustion chamber, (f) a cabinet having a lid over said removable tank, and (g) a tank guide which holds said tank in a vertical position in said cabinet, said fuel chamber being arranged to carry liquid fuel from said removable tank to said wick of said combustion chamber, said apparatus comprising a thermal barrier for isolating said removable tank from the heat of said reflector and said combustion chamber.

2. An apparatus according to claim 1 wherein said thermal barrier comprises a deflector located between said reflector and said removable tank.

3. An apparatus according to claim 1 wherein said thermal barrier comprises a deflector and an air diverter, both of which are located between said reflector and said removable tank.

4. An apparatus according to claim 1 wherein said thermal barrier comprises an opening in the top surface of said cabinet, said opening being located distal to said tank guide.

5. An apparatus according to claim 1 wherein said thermal barrier comprises an opening in said lid, and an opening in the lower part of said cabinet in the vicinity of said removable tank.

6. An apparatus according to claim 1 wherein said thermal barrier comprises a deflector and air diverter, both of which are located between said reflector and said removable tank, and further including an opening in the top surface of said cabinet, said opening being located distal to said tank guide.

7. An apparatus according to claim 1, further including means for providing a visual danger indication to alert a user if a dangerous condition of excess fuel is present in said fuel chamber.

8. An apparatus for preventing flareup in a liquid fuel burner of the type comprising:

(a) a removable liquid fuel tank, (b) a fuel chamber, (c) an automatic wick extinguishing unit, (d) a combustion chamber having a wick, (e) a reflector adjacent said combustion chamber, and (f) a cabinet having a lid over said removable tank, said fuel chamber being arranged to carry liquid fuel from said removable tank to said wick of said combustion chamber, said apparatus comprising excess fuel containment means for receiving and holding any excess fuel which flows into said fuel chamber from said removable tank, said excess fuel containment means comprising a fuel containment compartment connected to and positioned above said fuel chamber.

9. An apparatus according to claim 8 wherein said excess fuel containment means also comprises a fuel containment sump.

10. An apparatus according to claim 8, further including means for providing a visual danger indication to alert a user if a dangerous condition of excess fuel is present in said fuel chamber.

11. An apparatus according to claim 8 wherein said fuel containment means also comprises a fuel containment sump, and further including a warning means that is responsive to the presence of said excess fuel in said fuel chamber.

12. An apparatus according to claim 8 wherein said fuel containment means comprises an overflow tube connecting said fuel chamber to said fuel containment compartment.

13. An apparatus according to claim 12 wherein said overflow tube which connects said fuel chamber to said fuel containment compartment extends from a side of said fuel chamber up to a bottom of said fuel containment compartment.

14. An apparatus according to claim 8 wherein said excess fuel containment means also includes (a) means for providing a visual danger indication to alert the user of the dangerous condition of said excess fuel In said fuel chamber, and (b) means for directing the flow of said excess fuel into said fuel containment compartment, said directing means comprising an overflow tube which connects said fuel chamber to said fuel containment compartment.

15. An apparatus according to claim 8 wherein said excess fuel containment means comprises a fuel containment sump.

16. An apparatus according to claim 8 wherein said excess fuel containment means comprises a fuel containment sump, and further including means for providing a visual danger indication to alert a user of a dangerous condition of said excess fuel present in said fuel chamber.

17. A method of preventing flare-up in a liquid fuel burner of the type comprising a liquid fuel removable tank, a fuel chamber, an automatic wick extinguishing unit, and a combustion chamber having a wick, a reflector, and a cabinet having a lid over said removable tank, where said fuel chamber carries liquid fuel from said removable tank to said wick of said combustion chamber, comprising the steps of:

insulating said removable tank from the heat of said reflector, and containing elevated levels of fuel in said fuel chamber by capturing fuel which exceeds a predetermined level in said fuel chamber by providing an excess fuel containment compartment which is connected to and positioned above said fuel chamber.

18. The method of claim 17 wherein said insulating said removable tank comprises isolating said removable tank by providing a deflector and an air diverter between said tank and said reflector.

19. The method of claim 17 wherein said containing elevated levels of fuel in said fuel chamber comprises providing an overflow tube connecting said fuel chamber to said fuel containment compartment.

20. The method of claim 17, further including providing a visual danger indication to alert a user of a dangerous condition of said excess fuel present in said fuel chamber.

* * * * *